US011855352B2

(12) United States Patent
Tang et al.

(10) Patent No.: US 11,855,352 B2
(45) **Date of Patent: *Dec. 26, 2023**

(54) MULTI-BAND BASE STATION ANTENNAS HAVING BROADBAND DECOUPLING RADIATING ELEMENTS AND RELATED RADIATING ELEMENTS

(71) Applicant: CommScope Technologies LLC, Hickory, NC (US)

(72) Inventors: Chengcheng Tang, Murphy, TX (US); Gangyi Deng, Allen, TX (US); Peter J. Bisiules, La Grange Park, IL (US); Yunzhe Li, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/084,592

(22) Filed: Dec. 20, 2022

(65) Prior Publication Data

US 2023/0120414 A1 Apr. 20, 2023

Related U.S. Application Data

(60) Continuation of application No. 17/237,098, filed on Apr. 22, 2021, now Pat. No. 11,563,278, which is a (Continued)

(30) Foreign Application Priority Data

Aug. 24, 2018 (CN) ..... 201810971466.4

(51) Int. Cl.
*H01Q 21/06* (2006.01)
*H01Q 21/26* (2006.01)
(Continued)

(52) U.S. Cl.
CPC ..... *H01Q 21/062* (2013.01); *H01Q 1/246* (2013.01); *H01Q 5/48* (2015.01); *H01Q 21/26* (2013.01)

(58) Field of Classification Search
CPC .... H01Q 21/06; H01Q 21/061; H01Q 21/062; H01Q 21/24; H01Q 21/26; H01Q 21/28; H01Q 5/40; H01Q 5/48; H01Q 1/246
See application file for complete search history.

(56) References Cited

U.S. PATENT DOCUMENTS 6,028,563 A * 2/2000 Higgins ..... H01Q 1/246 343/810
9,490,542 B1 * 11/2016 Prinsloo ..... H01Q 21/26
(Continued)

FOREIGN PATENT DOCUMENTS

CN 1886864 A 12/2006
CN 103633422 A 3/2014
(Continued)

OTHER PUBLICATIONS

"Extended European Search Report for corresponding European Patent Application No. 19193002.3-1205, dated Nov. 25, 2019, 9 pages".

(Continued)

*Primary Examiner* — Jason Crawford
(74) *Attorney, Agent, or Firm* — Myers Bigel, P.A.

(57) ABSTRACT

Radiating elements include a first and second dipole arms that extend along a first axis and that are configured to transmit RF signals in a first frequency band. The first dipole arm is configured to be more transparent to RF signals in a second frequency band than it is to RF signals in a third frequency band, and the second dipole arm is configured to be more transparent to RF signals in the third frequency
(Continued)

band than it is to RF signals in the second frequency band. Related base station antennas are also provided.

20 Claims, 7 Drawing Sheets

Related U.S. Application Data division of application No. 16/545,790, filed on Aug. 20, 2019, now Pat. No. 11,018,437.

(51) Int. Cl.
*H01Q 5/48* (2015.01)
*H01Q 1/24* (2006.01)

(56) References Cited

U.S. PATENT DOCUMENTS

| | | | | |
|---|---|---|---|---|
| 9,570,804 | B2 | 2/2017 | Shang et al. | |
| 9,722,321 | B2 | 8/2017 | Bisiules et al. | |
| 11,018,437 | B2 * | 5/2021 | Tang | H01Q 9/22 |
| 11,563,278 | B2 * | 1/2023 | Tang | H01Q 1/521 |
| 2007/0008236 | A1 * | 1/2007 | Tillery | H01Q 21/30 343/810 |
| 2007/0241983 | A1 * | 10/2007 | Cao | H01Q 21/26 343/797 |
| 2011/0298682 | A1 * | 12/2011 | Plet | H01Q 21/06 343/797 |
| 2012/0146869 | A1 * | 6/2012 | Holland | H01Q 21/26 343/795 |
| 2012/0280878 | A1 * | 11/2012 | Timofeev | H01Q 1/246 343/793 |
| 2015/0070234 | A1 * | 3/2015 | Jones | H01Q 21/28 343/797 |
| 2015/0084823 | A1 * | 3/2015 | Wang | H01Q 25/001 343/797 |
| 2015/0138032 | A1 * | 5/2015 | Yona | H01Q 21/24 343/816 |
| 2016/0248170 | A1 | 8/2016 | Bisiules et al. | |
| 2017/0062952 | A1 * | 3/2017 | Sundararajan | H01Q 1/246 |
| 2017/0294704 | A1 | 10/2017 | Sun et al. | |
| 2017/0310009 | A1 | 10/2017 | Isik et al. | |
| 2018/0034164 | A1 * | 2/2018 | Jang | H01Q 1/38 |
| 2018/0040955 | A1 * | 2/2018 | Vouvakis | H01Q 9/065 |
| 2018/0227775 | A1 * | 8/2018 | Bisiules | H01Q 5/48 |
| 2018/0323513 | A1 * | 11/2018 | Varnoosfaderani | H01Q 21/062 |
| 2018/0331419 | A1 * | 11/2018 | Varnoosfaderani | H01Q 13/10 |
| 2018/0337443 | A1 * | 11/2018 | Bisiules | H01Q 1/246 |
| 2019/0280377 | A1 * | 9/2019 | Zhang | H01Q 1/246 |
| 2020/0028244 | A1 * | 1/2020 | Hu | H01Q 1/246 |
| 2020/0044365 | A1 * | 2/2020 | Song | H01Q 5/392 |
| 2020/0067197 | A1 * | 2/2020 | Tang | H01Q 5/42 |
| 2020/0127389 | A1 * | 4/2020 | Li | H01Q 5/378 |
| 2020/0161748 | A1 * | 5/2020 | Isik | H01Q 21/08 |
| 2020/0212598 | A1 * | 7/2020 | Gonzalez | H01Q 5/48 |
| 2020/0321700 | A1 * | 10/2020 | Wu | H01Q 19/10 |
| 2020/0373668 | A1 * | 11/2020 | Wu | H01Q 9/285 |
| 2021/0242603 | A1 * | 8/2021 | Tang | H01Q 5/321 |
| 2023/0071050 | A1 * | 3/2023 | Sun | H01Q 5/42 |
| 2023/0120414 | A1 * | 4/2023 | Tang | H01Q 21/26 343/702 |

FOREIGN PATENT DOCUMENTS

| | | | |
|---|---|---|---|
| CN | 104067527 | A | 9/2014 |
| CN | 107078390 | A | 8/2017 |
| CN | 107210518 | A | 9/2017 |
| CN | 107275804 | A | 10/2017 |
| CN | 107743665 | A | 2/2018 |
| WO | 2014100938 | A1 | 7/2014 |
| WO | 2015062545 | A1 | 5/2015 |
| WO | 2020010039 | A1 | 1/2020 |

OTHER PUBLICATIONS

"Extended European Search Report for European Application No. 21200086.3, dated Jan. 14, 2022, 11 pages".
"Chinese Office Action in Corresponding Patent Application No. 201810971466.4, dated Apr. 25, 2023, 14 pages".

* cited by examiner

MULTI-BAND BASE STATION ANTENNAS HAVING BROADBAND DECOUPLING RADIATING ELEMENTS AND RELATED RADIATING ELEMENTS

CROSS-REFERENCE TO RELATED APPLICATION

The present application is a continuation application under 35 U.S.C. § 120 of U.S. patent application Ser. No. 17/237,098, filed Apr. 22, 2021, which in turn is a divisional application under 35 U.S.C. § 120 of U.S. patent application Ser. No. 16/545,790, filed Aug. 20, 2019, which in turn claims priority under 35 U.S.C. § 119 to Chinese Patent Application Serial No. 201810971466.4, filed Aug. 24, 2018, the entire content of each of which is incorporated herein by reference.

BACKGROUND

The present invention generally relates to radio communications and, more particularly, to base station antennas for cellular communications systems.

Cellular communications systems are well known in the art. In a cellular communications system, a geographic area is divided into a series of regions that are referred to as "cells" which are served by respective base stations. The base station may include one or more antennas that are configured to provide two-way radio frequency ("RF") communications with mobile subscribers that are within the cell served by the base station. In many cases, each base station is divided into "sectors." In one common configuration, a hexagonally shaped cell is divided into three 120° sectors in the azimuth plane, and each sector is served by one or more base station antennas that have an azimuth Half Power Beam width (HPBW) of approximately 65°. Typically, the base station antennas are mounted on a tower or other raised structure, with the radiation patterns (also referred to herein as "antenna beams") that are generated by the base station antennas directed outwardly. Base station antennas are often implemented as linear or planar phased arrays of radiating elements.

In order to accommodate the increasing volume of cellular communications, cellular operators have added cellular service in a variety of new frequency bands. While in some cases it is possible to use a single linear array of so-called "wide-band" or "ultra wide-band" radiating elements to provide service in multiple frequency bands, in other cases it is necessary to use different linear arrays (or planar arrays) of radiating elements to support service in the different frequency bands.

As the number of frequency bands has proliferated, and increased sectorization has become more common (e.g., dividing a cell into six, nine or even twelve sectors), the number of base station antennas deployed at a typical base station has increased significantly. However, due to, for example, local zoning ordinances and/or weight and wind loading constraints for the antenna towers, there is often a limit as to the number of base station antennas that can be deployed at a given base station. In order to increase capacity without further increasing number of base station antennas, so-called multi-band base station antennas have been introduced which include multiple linear arrays of radiating elements. One common multi-band base station antenna design includes one linear array of "low-band" radiating elements that are used to provide service in some or all of the 694-960 MHz frequency band and two linear arrays of "mid-band" radiating elements that are used to provide service in some or all of the 1427-2690 MHz frequency band. These linear arrays are mounted in side-by-side fashion. Another known multi-band base station antenna includes two linear arrays of low-band radiating elements and two linear arrays of mid-band radiating elements. There is also interest in deploying base station antennas that includes one or more linear arrays of "high-band" radiating elements that operate in higher frequency bands, such as the 3.3-4.2 GHz frequency band.

SUMMARY

Pursuant to embodiments of the present invention, radiating elements are provided that include first and second dipole arms that extend along a first axis and that are configured to transmit RF signals in a first frequency band. The first dipole arm is configured to be more transparent to RF signals in a second frequency band than it is to RF signals in a third frequency band, and the second dipole arm is configured to be more transparent to RF signals in the third frequency band than it is to RF signals in the second frequency band.

In some embodiments, each of the first and second dipole arms includes a plurality of widened sections that are connected by intervening narrowed sections. The second dipole arm may have more widened sections than does the first dipole arm. An average electrical distance between adjacent narrowed sections of the second dipole arm may be less than an average electrical distance between adjacent narrowed sections of the first dipole arm. An average length of the widened sections of the second dipole arm is less than an average length of the widened sections of the first dipole arm. The narrowed sections of the first dipole arm may be configured to create a high impedance for RF signals that are in the second frequency band, and the narrowed sections of the second dipole arm may be configured to create a high impedance for RF signals that are in the third frequency band.

In some embodiments, the radiating element may be a dual polarized radiating element. In such embodiments, the first dipole arm and the second dipole arm may together form a first dipole, and the radiating element may further include a second dipole that extends along a second axis and that is configured to transmit RF signals in the first frequency band, the second dipole including a third dipole arm and a fourth dipole arm and the second axis being generally perpendicular to the first axis. In such embodiments, the third dipole arm may be configured to be more transparent to RF signals in the second frequency band than it is to RF signals in the third frequency band, and the fourth dipole arm may be configured to be more transparent to RF signals in the third frequency band than it is to RF signals in the second frequency band. The first and second dipoles may be center-fed from a common RF transmission line. The radiating element may further comprise at least one feed stalk that extends generally perpendicular to a plane defined by the first and second dipoles.

The radiating elements according to these embodiments of the present invention may be mounted on a base station antenna as part of a first linear array of radiating elements that are configured to transmit RF signals in the first frequency band. The base station antenna may further include a second linear array of radiating elements that are configured to transmit RF signals in the second frequency band and a third linear array of radiating elements that are configured to transmit RF signals in the third frequency band. The first linear array may be mounted between the second linear array and the third linear array so that the first and third dipole arms project toward the second linear array and the second and fourth dipole arms project toward the third linear array. In some cases, the first dipole arm may vertically overlap one of the radiating elements in the second linear array of radiating elements and/or the second dipole arm may vertically overlap one of the radiating elements in the third linear array of radiating elements. In embodiments where the radiating element is a dual-polarized radiating element, each of the first through fourth dipoles arms may include first and second spaced-apart conductive segments that together form a generally oval shape. In some embodiments, an electrical length of second dipole arm is less than an electrical length of the first dipole arm.

Pursuant to further embodiments of the present invention, dual-polarized radiating elements are provide that include (1) a first dipole that extends along a first axis and that is configured to transmit RF signals in a first frequency band, the first dipole including a first dipole arm and a second dipole arm and (2) a second dipole that extends along a second axis and that is configured to transmit RF signals in the first frequency band, the second dipole including a third dipole arm and a fourth dipole arm, and the second axis being generally perpendicular to the first axis. Each of the first through fourth dipole arms includes a plurality of widened sections that are connected by intervening narrowed sections, and the second dipole arm includes more widened sections than does the first dipole arm.

In some embodiments, the second dipole arm may have at least 50% more widened sections than does the first dipole arm. In other embodiments, the second dipole arm may have at least twice as many widened sections than does the first dipole arm. The first dipole arm and the third dipole arm may have the same number of widened sections. At least some of the narrowed sections may comprise meandered conductive traces. Each of the first through fourth dipoles arms may have first and second spaced-apart conductive segments that together form a generally oval shape.

Pursuant to still further embodiments of the present invention, base station antennas are provided that include a first linear array of dual-polarized low-band radiating elements that are configured to transmit RF signals in a first frequency band, a second linear array of mid-band radiating elements that are configured to transmit RF signals in a second frequency band and a third linear array of high-band radiating elements that are configured to transmit RF signals in a third frequency band. The first linear array of dual-polarized low-band radiating elements is positioned between the second linear array of mid-band radiating elements and the third linear array of high-band radiating elements. Each low-band radiating element includes a first dipole having first and second dipole arms that extend along a first axis and a second dipole having third and fourth dipole arms that extend along a second axis. The first dipole arm vertically overlaps one of the radiating elements in the second linear array of mid-band radiating elements.

In some embodiments, the second dipole arm may vertically overlap one of the radiating elements in the third linear array of high-band radiating elements.

In some embodiments, an electrical length of the first dipole arm exceeds an electrical length of the second dipole arm by at least 3 percent. In other embodiments, an electrical length of the first dipole arm may exceed an electrical length of the second dipole arm by 5% to 15%.

In some embodiments, each of the first through fourth dipole arms each include a plurality of widened sections that are connected by intervening narrowed sections. The second dipole arm may have more widened sections than does the first dipole arm.

DETAILED DESCRIPTION

Figure 1:
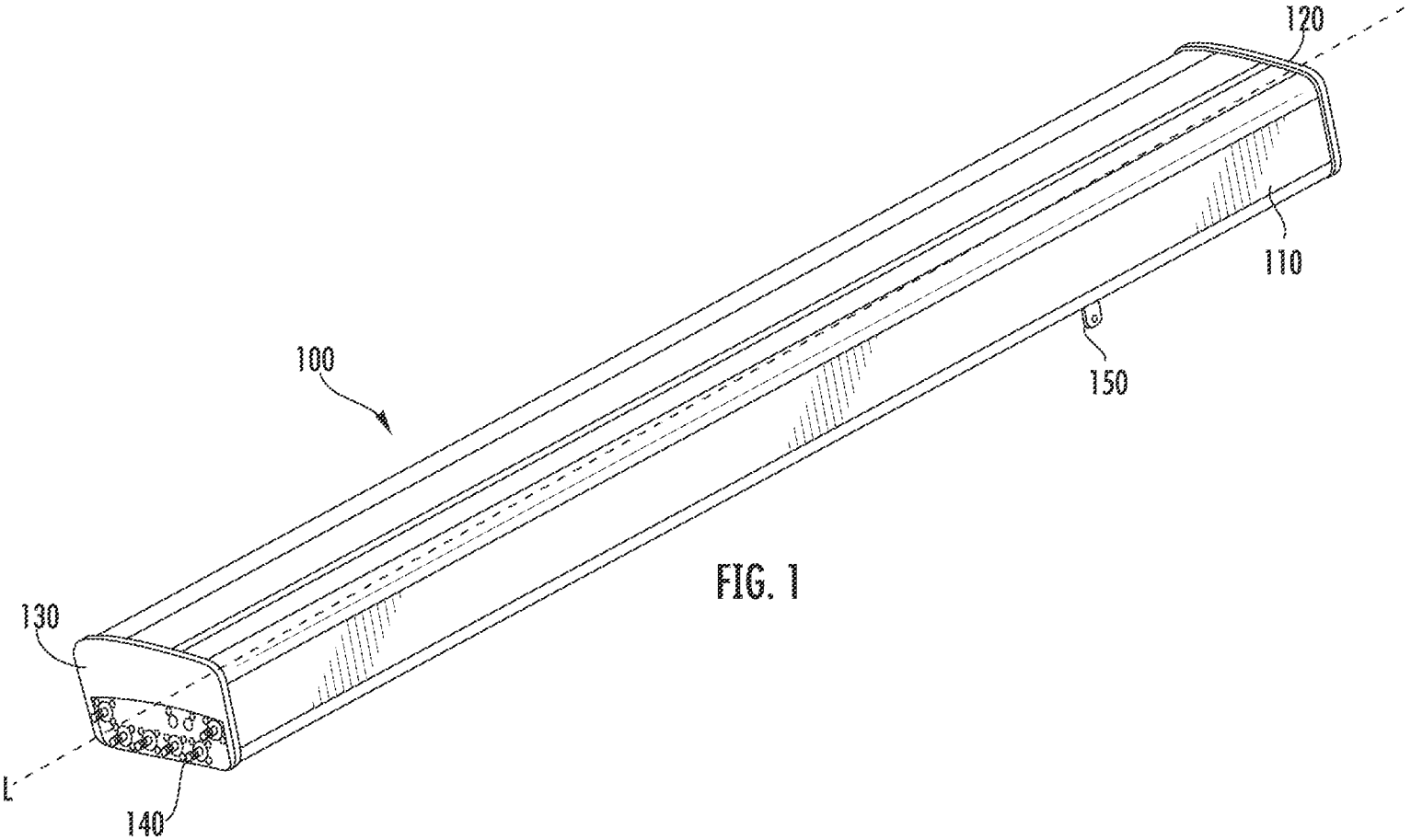
FIG. 1 is a perspective view of a base station antenna according to embodiments of the present invention.

Embodiments of the present invention relate generally to radiating elements for a multi-band base station antenna and to related base station antennas. The multi-band base station antennas according to embodiments of the present invention may support three or more major air-interface standards in three or more cellular frequency bands and allow wireless operators to reduce the number of antennas deployed at base stations, lowering tower leasing costs while increasing speed to market capability.

A challenge in the design of multi-band base station antennas is reducing the effect of scattering of the RF signals at one frequency band by the radiating elements of other frequency bands. Scattering is undesirable as it may affect the shape of the antenna beam in both the azimuth and elevation planes, and the effects may vary significantly with frequency, which may make it hard to compensate for these effects. Moreover, at least in the azimuth plane, scattering tends to impact the beamwidth, beam shape, pointing angle, gain and front-to-back ratio in undesirable ways. The radiating elements according to certain embodiments of the present invention may be designed to have reduced impact on the antenna pattern of closely located radiating elements that transmit and receive signals in two other frequency bands (i.e., reduced scattering).

Pursuant to embodiments of the present invention, multi-band base station antennas are provided that have linear arrays of first, second and third radiating elements that transmit and receive signals in respective first, second and third different frequency bands. Each first radiating element may be a broadband decoupling radiating element that has a dipole with a first dipole arm that is substantially transparent to RF energy in the second frequency band, and a second dipole arm that is substantially transparent to RF energy in the third frequency band. By providing dipoles having first and second dipole arms that are transparent to RF energy in two different frequency bands it is possible to closely position the second radiating elements that operate in the second frequency band on one side of the first radiating elements and to closely position the third radiating elements that operate in the third frequency band on the other side of the first radiating elements without the first radiating elements materially impacting the antenna patterns formed by the linear arrays of second and third radiating elements.

In an example embodiment, a multi-band base station antenna is provided that includes a first linear array of low-band radiating elements, a second linear array of mid-band radiating elements and a third linear array of high-band radiating elements. The first linear array of low-band radiating elements may be positioned between the second linear array of mid-band radiating elements and the third linear array of high-band radiating elements. The low-band radiating elements may be dual polarized cross-dipole radiating elements that include first and second dipoles, each of which has first and second dipole arms. The first dipole arm of each low-band radiating element may be designed to be substantially transparent to the RF energy transmitted by the mid-band radiating elements, while the second dipole arm of each low-band radiating element may be designed to be substantially transparent to the RF energy transmitted by the high-band radiating elements. Since the first dipole arms of each low-band radiating element are substantially transparent to mid-band RF energy, the first dipole arms may project towards (and potentially over) respective ones of the mid-band radiating elements. Likewise, since the second dipole arms of each low-band radiating element are substantially transparent to high-band RF energy, the second dipole arms may project towards (and potentially over) respective ones of the high-band radiating elements. Thus, the low-band radiating elements may allow the linear arrays to be more closely spaced together, reducing the width of the antenna, without degrading RF performance.

In some embodiments of the present invention, radiating elements are provided that include first and second dipole arms that extend along a first axis and that are configured to transmit RF signals in a first frequency band. The first dipole arm is configured to be more transparent to RF signals in a second frequency band than it is to RF signals in a third frequency band, and the second dipole arm is configured to be more transparent to RF signals in the third frequency band than it is to RF signals in the second frequency band. Each of the first and second dipole arms may include a plurality of widened sections that are connected by intervening narrowed sections. The second dipole arm may have more widened sections than does the first dipole arm, and/or an average electrical distance between adjacent narrowed sections of the second dipole arm may be less than an average electrical distance between adjacent narrowed sections of the first dipole arm. An average length of the widened sections of the second dipole arm may also be less than an average length of the widened sections of the first dipole arm. The narrowed sections of the first dipole arm may be configured to create a high impedance for RF signals that are in the second frequency band, and the narrowed sections of the second dipole arm may be configured to create a high impedance for RF signals that are in the third frequency band.

In other embodiments, dual-polarized radiating elements are provide that include (1) a first dipole that extends along a first axis and that is configured to transmit RF signals in a first frequency band, the first dipole including a first dipole arm and a second dipole arm and (2) a second dipole that extends along a second axis and that is configured to transmit RF signals in the first frequency band, the second dipole including a third dipole arm and a fourth dipole arm. Each of the first through fourth dipole arms includes a plurality of widened sections that are connected by intervening narrowed sections, and the second dipole arm includes more widened sections than does the first dipole arm.

According to further embodiments, base station antennas are provided that include first, second and third linear arrays of radiating elements that are configured to transmit RF signals in respective first, second and third frequency bands. The first linear array is positioned between the second and third linear arrays. The radiating elements in the first linear array each include a first dipole that has first and second dipole arms that extend along a first axis and a second dipole that has third and fourth dipole arms that extend along a second axis, where the first dipole arm vertically overlaps one of the radiating elements in the second linear array and/or the second dipole arm vertically overlaps one of the radiating elements in the third linear array. An electrical length of the first dipole arm may be greater than an electrical length of the second dipole arm.

Embodiments of the present invention will now be described in further detail with reference to the attached figures.

Figure 2:
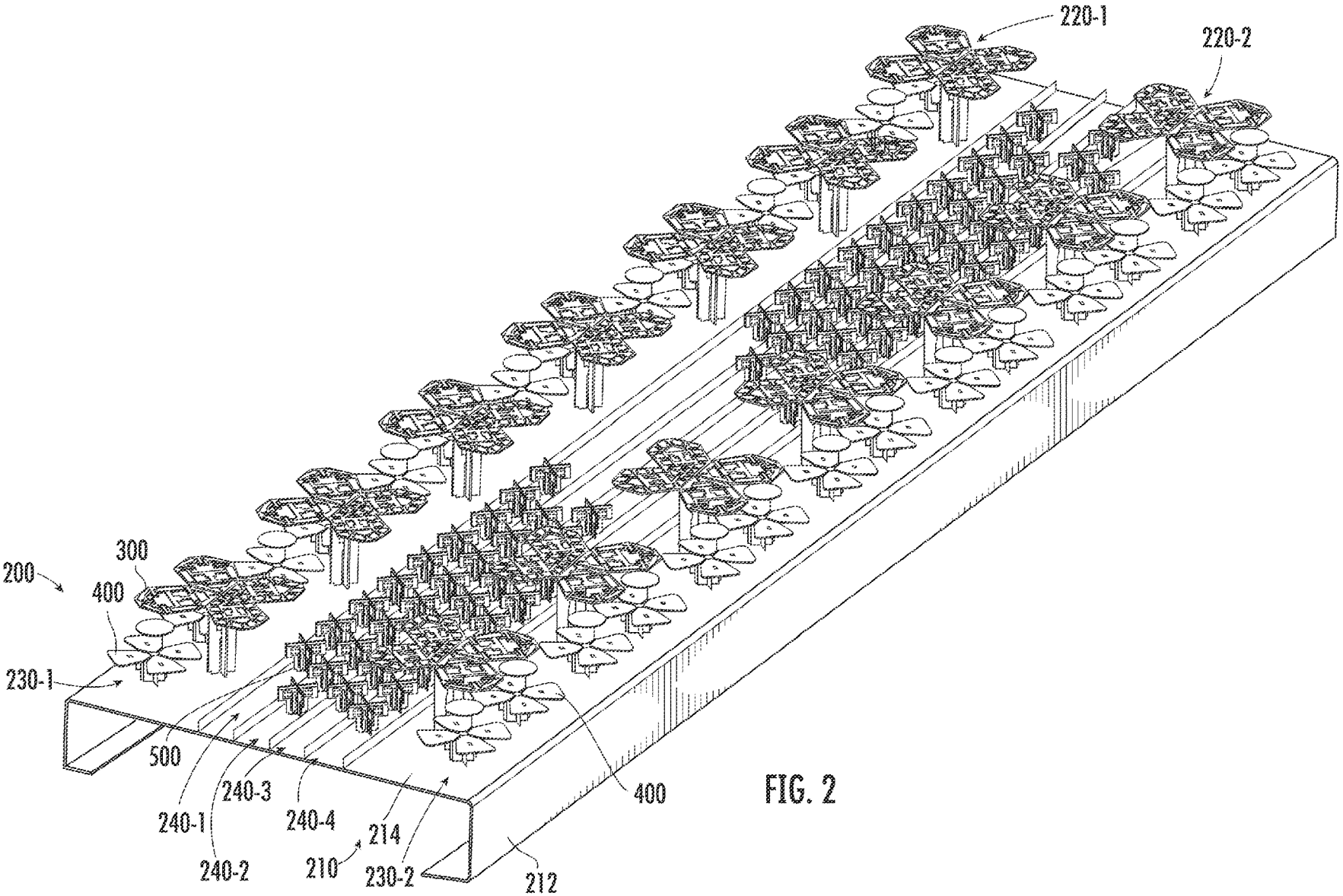
FIG. 2 is a perspective view of the base station antenna of FIG. 1 with the radome removed.
Figure 3:
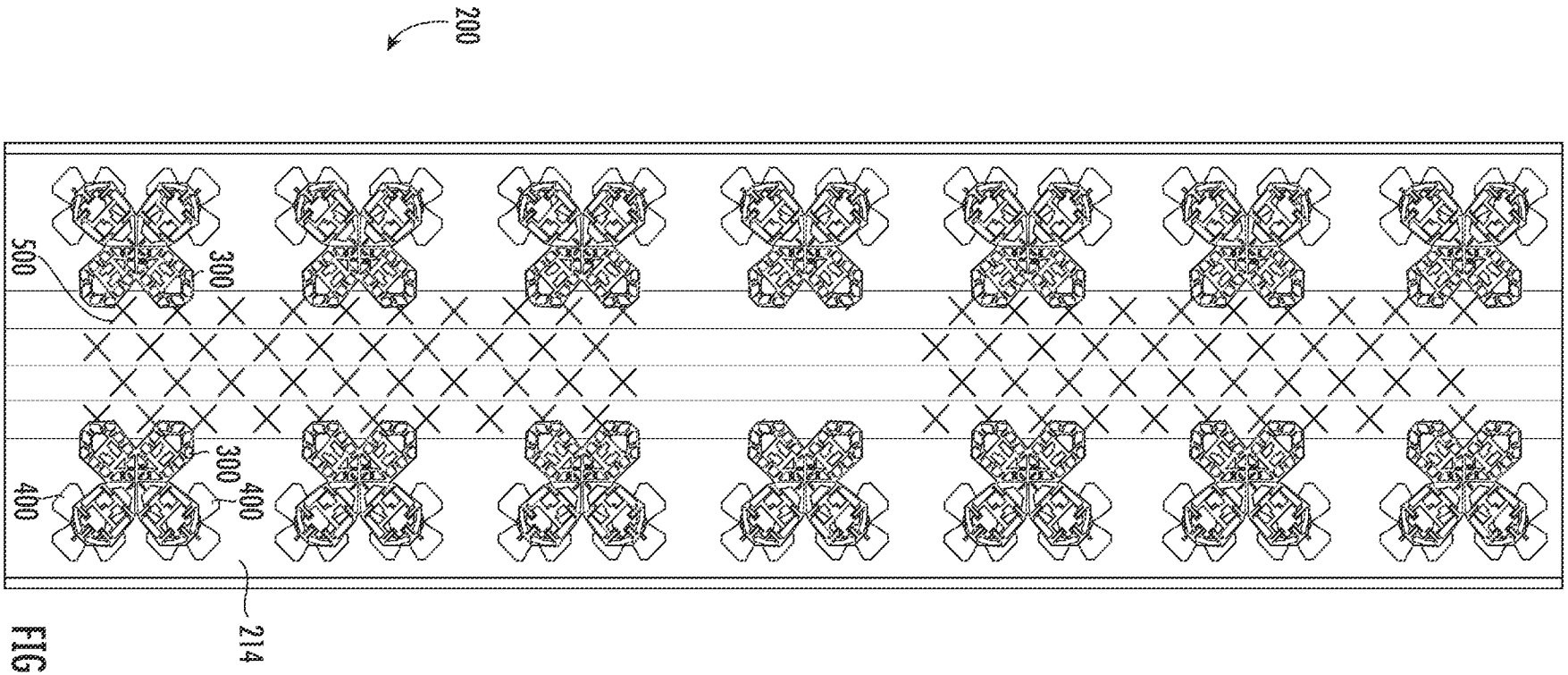
FIG. 3 is a front view of the base station antenna of FIG. 1 with the radome removed.
Figure 4:
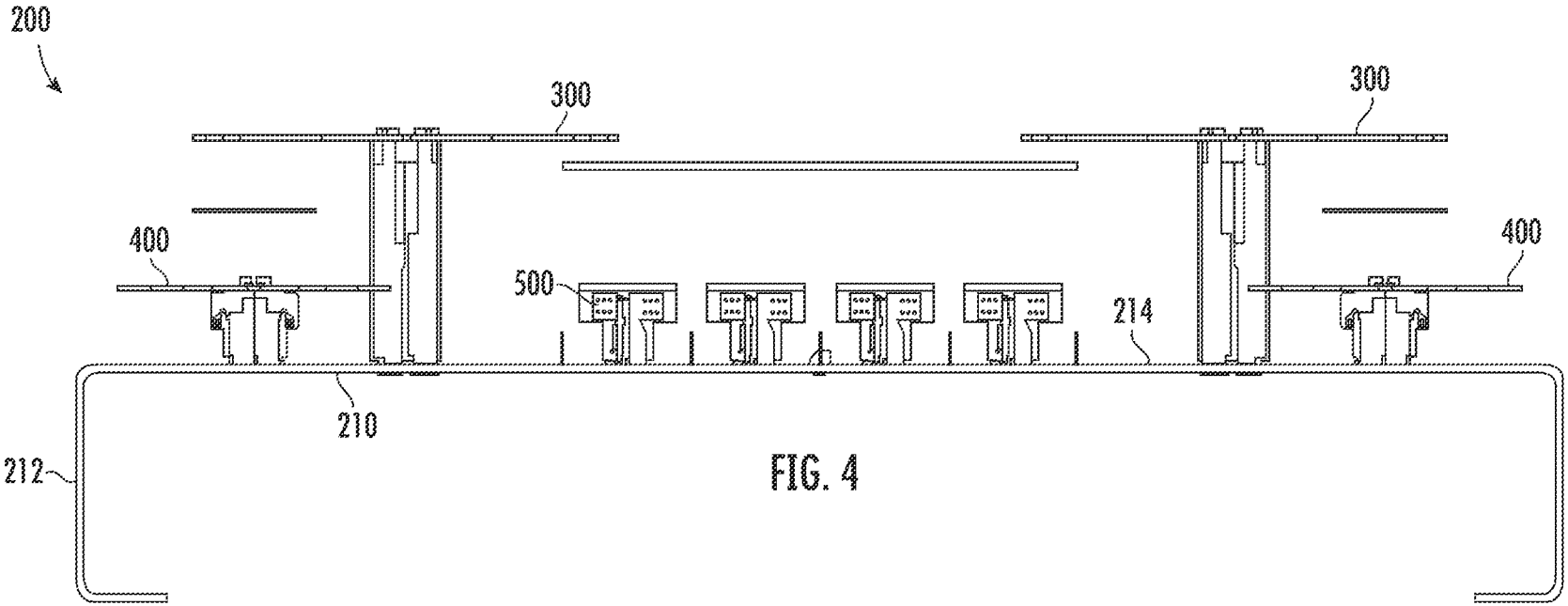
FIG. 4 is a cross-sectional view of the base station antenna of FIG. 1 with the radome removed.
Figure 5:
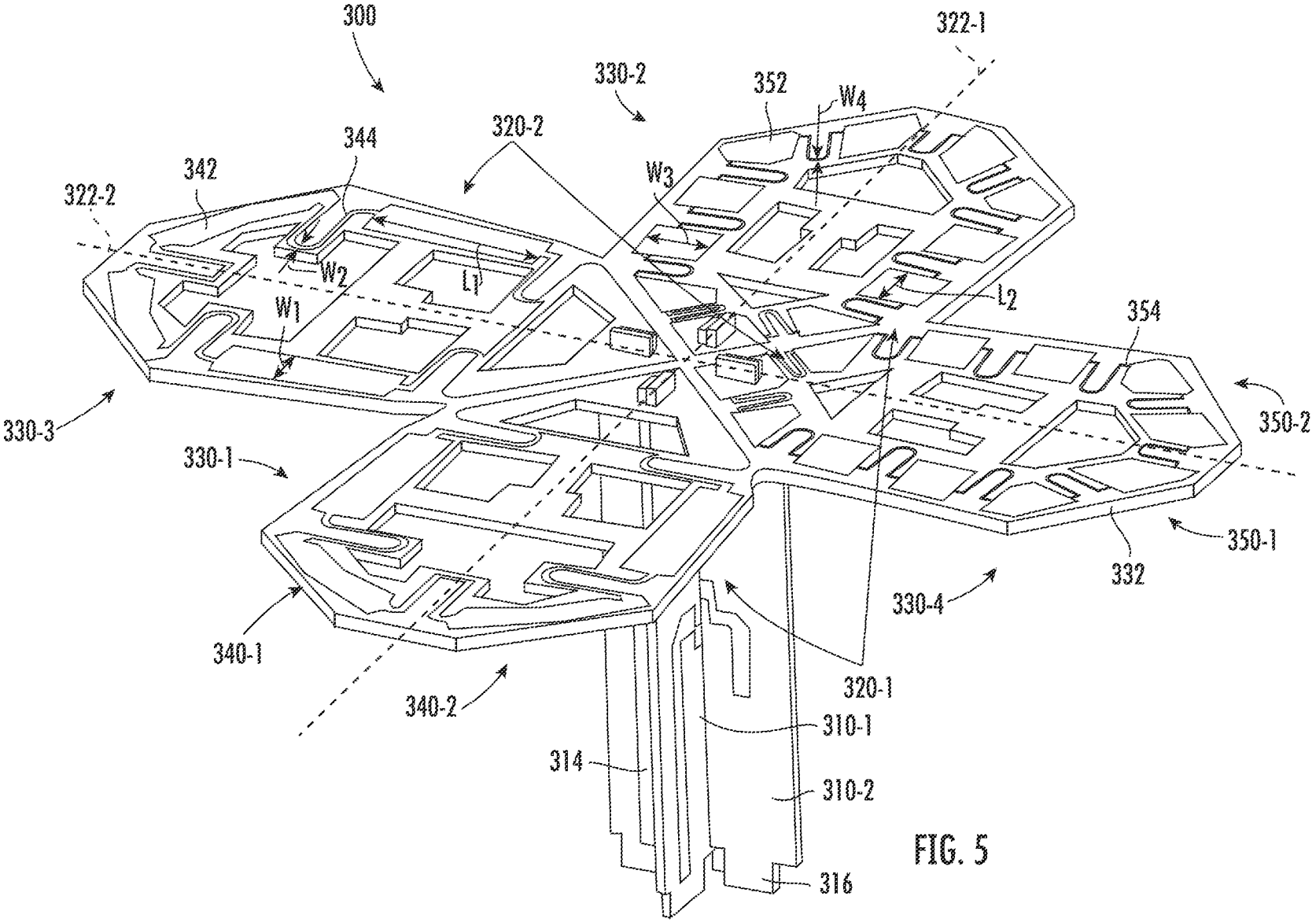
FIG. 5 is an enlarged perspective view of one of the low-band radiating elements of the base station antenna of FIGS. 1-4.
Figure 6:
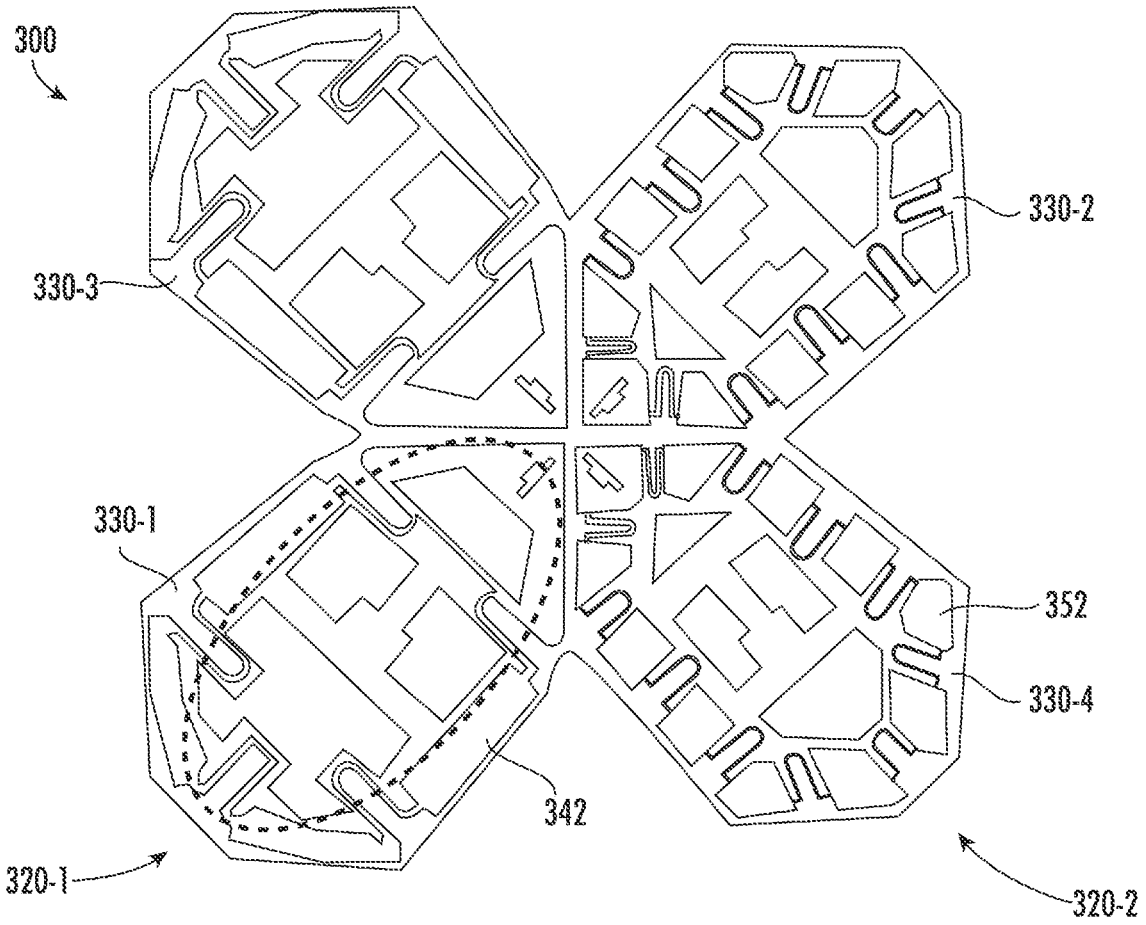
FIG. 6 is an enlarged plan view of one of the low-band radiating elements of the base station antenna of FIGS. 1-4.

FIGS. 1-4 illustrate a base station antenna 100 according to certain embodiments of the present invention. In particular, FIG. 1 is a perspective view of the antenna 100, while FIGS. 2-4 are a perspective view, a front view and cross-sectional view, respectively, of the antenna 100 with the radome thereof removed to illustrate the antenna assembly 200 of the antenna 100. FIGS. 5-6 are a perspective view and a plan view, respectively, of one of the low-band radiating elements included in the base station antenna 100.

In the description that follows, the antenna 100 will be described as a whole using terms that assume that the antenna 100 is mounted for use on a tower with the longitudinal axis of the antenna 100 extending along a vertical axis and the front surface of the antenna 100 mounted opposite the tower pointing toward the coverage area for the antenna 100. In contrast, the antenna assembly 200 and its constituent individual components that are depicted in FIGS. 2-6 such as, for example, the radiating elements, are described using terms that assume that the antenna assembly 200 is mounted on a horizontal surface with the radiating elements extending upwardly, which is generally consistent with the orientation of the antenna assembly depicted in FIGS. 2-4. Thus, as an example, each radiating element may be described as extending "above" the reflector of the antenna in the description that follows, even though when the antenna 100 is mounted for use the radiating elements will in fact extend forwardly from reflector as opposed to above the reflector.

As shown in FIGS. 1-4, the base station antenna 100 is an elongated structure that extends along a longitudinal axis L. The base station antenna 100 may have a tubular shape with generally rectangular cross-section. The antenna 100 includes a radome 110 and a top end cap 120. In some embodiments, the radome 110 and the top end cap 120 may comprise a single integral unit, which may be helpful for waterproofing the antenna 100. One or more mounting brackets 150 are provided on the rear side of the antenna 100 which may be used to mount the antenna 100 onto an antenna mount (not shown) on, for example, an antenna tower. The antenna 100 also includes a bottom end cap 130 which includes a plurality of connectors 140 mounted therein. The antenna 100 is typically mounted in a vertical configuration (i.e., the longitudinal axis L may be generally perpendicular to a plane defined by the horizon) when the antenna 100 is mounted for normal operation. The radome 110, top cap 120 and bottom cap 130 may form an external housing for the antenna 100. An antenna assembly 200 is contained within the housing. The antenna assembly 200 may be slidably inserted into the radome 110 from either the top or bottom before the top cap 120 or bottom cap 130 are attached to the radome 110.

FIGS. 2-4 are a perspective view, a front view and a cross-sectional view, respectively, of the antenna assembly 200 of base station antenna 100. As shown in FIGS. 2-4, the antenna assembly 200 includes a ground plane structure 210 that has sidewalls 212 and a reflector surface 214. Various mechanical and electronic components of the antenna (not shown) may be mounted in the chamber defined between the sidewalls 212 and the back side of the reflector surface 214 such as, for example, phase shifters, remote electronic tilt units, mechanical linkages, a controller, diplexers, and the like. The reflector surface 214 of the ground plane structure 210 may comprise or include a metallic surface that serves as a reflector and ground plane for the radiating elements of the antenna 100. Herein the reflector surface 214 may also be referred to as the reflector 214.

A plurality of dual-polarized radiating elements 300, 400, 500 are mounted to extend upwardly from the reflector surface 214 of the ground plane structure 210. The radiating elements include low-band radiating elements 300, mid-band radiating elements 400 and high-band radiating elements 500. The low-band radiating elements 300 are mounted in two columns to form two linear arrays 220-1, 220-2 of low-band radiating elements 300. Each low-band linear array 220 may extend along substantially the full length of the antenna 100 in some embodiments. The mid-band radiating elements 400 may likewise be mounted in two columns to form two linear arrays 230-1, 230-2 of mid-band radiating elements 400. The high-band radiating elements 500 are mounted in four columns to form four linear arrays 240-1 through 240-4 of high-band radiating elements 500. In other embodiments, the number of linear arrays of low-band, mid-band and/or high-band radiating elements may be varied from what is shown in FIGS. 2-4. It should be noted that herein like elements may be referred to individually by their full reference numeral (e.g., linear array 230-2) and may be referred to collectively by the first part of their reference numeral (e.g., the linear arrays 230).

In the depicted embodiment, the linear arrays 240 of high-band radiating elements 500 are positioned between the linear arrays 220 of low-band radiating elements 300, and each linear array 220 of low-band radiating elements 300 is positioned between a respective one of the linear arrays 240 of high-band radiating elements 500 and a respective one of the linear arrays 230 of mid-band radiating elements 400. The linear arrays 230 of mid-band radiating elements 400 may or may not extend the full length of the antenna 100, and the linear arrays 240 of high-band radiating elements 500 may or may not extend the full length of the antenna 100.

The low-band radiating elements 300 may be configured to transmit and receive signals in a first frequency band. In some embodiments, the first frequency band may comprise the 61794-960 MHz frequency range or a portion thereof (e.g., the 617-896 MHz frequency band, the 696-960 MHz frequency band, etc.). The mid-band radiating elements 400 may be configured to transmit and receive signals in a second frequency band. In some embodiments, the second frequency band may comprise the 1427-2690 MHz frequency range or a portion thereof (e.g., the 1710-2200 MHz frequency band, the 2300-2690 MHz frequency band, etc.). The high-band radiating elements 500 may be configured to transmit and receive signals in a third frequency band. In some embodiments, the third frequency band may comprise the 3300-4200 MHz frequency range or a portion thereof. The low-band linear arrays 220 may or may not be configured to transmit and receive signals in the same portion of the first frequency band. For example, in one embodiment, the low-band radiating elements 300 in the first linear array 220-1 may be configured to transmit and receive signals in the 700 MHz frequency band and the low-band radiating elements 300 in the second linear array 220-2 may be configured to transmit and receive signals in the 800 MHz frequency band. In other embodiments, the low-band radiating elements 300 in both the first and second linear arrays 220-1, 220-2 may be configured to transmit and receive signals in the 700 MHz (or 800 MHz) frequency band. The mid-band and high-band radiating elements 400, 500 in the different mid-band and high-band linear arrays 230, 240 may similarly have any suitable configuration.

The low-band, mid-band and high-band radiating elements 300, 400, 500 may each be mounted to extend upwardly above the ground plane structure 210. The reflector surface 214 of the ground plane structure 210 may comprise a sheet of metal that, as noted above, serves as a reflector and as a ground plane for the radiating elements 300, 400, 500.

As noted above, the low-band radiating elements 300 are arranged as two low-band arrays 220 of radiating elements. Each array 220-1, 220-2 may be used to form a pair of antenna beams, namely an antenna for each of the two polarizations at which the dual-polarized radiating elements are designed to transmit and receive RF signals. Each radiating element 300 in the first low-band array 220-1 may be horizontally aligned with a respective radiating element 300 in the second low-band array 220-2. Likewise, each radiating element 400 in the first mid-band array 230-1 may be horizontally aligned with a respective radiating element 400 in the second mid-band array 230-2. While not shown in the figures, the radiating elements 300, 400, 500 may be mounted on feed boards that couple RF signals to and from the individual radiating elements 300, 400, 500. One or more radiating elements 300, 400, 500 may be mounted on each feed board. Cables may be used to connect each feed board to other components of the antenna such as diplexers, phase shifters or the like.

While cellular network operators are interested in deploying antennas that have a large number of linear arrays of radiating elements in order to reduce the number of base station antennas required per base station, increasing the number of linear arrays typically increases the width of the antenna. Both the weight of a base station antenna and the wind loading the antenna will experience increase with increasing width, and thus wider base station antennas tend to require structurally more robust antenna mounts and antenna towers, both of which can significantly increase the cost of a base station. Accordingly, cellular network operators typically want to limit the width of a base station antenna to be below 500 mm. This can be challenging in base station antennas that include two linear arrays of low-band radiating elements, since most conventional low-band radiating elements that are designed to serve a 120° sector have a width of about 200 mm or more.

The width of a multi-band base station antenna may be reduced by decreasing the separation between adjacent linear arrays. However, as the separation is reduced, increased coupling between radiating elements of different linear arrays occurs, and this increased coupling may impact the shapes of the antenna beams generated by the linear arrays in undesirable ways. For example, a low-band cross-dipole radiating element will typically have dipole radiators that have a length that is approximately ½ a wavelength of the operating frequency. If the low-band radiating element is designed to operate in the 700 MHz frequency band, and the mid-band radiating elements are designed to operate in the 1400 MHz frequency band, the length of the low-band dipole radiators will be approximately one wavelength at the mid-band operating frequency. As a result, each dipole arm of a low-band dipole radiator will have a length that is approximately ½ a wavelength at the mid-band operating frequency, and hence RF energy transmitted by the mid-band radiating elements will tend to couple to the low-band radiating elements. This coupling can distort the antenna pattern of the mid-band linear array. Similar distortion can occur if RF energy emitted by the high-band radiating elements couples to the low-band radiating elements. The low-band radiating elements 300 according to embodiments of the present invention may be designed to be substantially transparent to closely-located mid-band and high-band radiating elements 400, 500 so that undesired coupling of mid-band and/or high-band RF energy onto the low-band radiating elements 300 may be significantly reduced.

Referring now to FIGS. 5-6, one of the low-band radiating elements 300 will be described in greater detail. The low-band radiating element 300 includes a pair of feed stalks 310, and first and second dipoles 320-1, 320-2. The first dipole 320-1 includes first and second dipole arms 330-1, 330-2, and the second dipole 320-2 includes third and fourth dipole arms 330-3, 330-4. The feed stalks 310 may each comprise a printed circuit board that has RF transmission lines 314 formed thereon. These RF transmission lines 314 carry RF signals between a feed board (not shown) and the dipoles 320. Each feed stalk 310 may further include a hook balun. A first of the feed stalks 310-1 may include a lower vertical slit and the second of the feed stalks 310-2 includes an upper vertical slit. These vertical slits allow the two feed stalks 310 to be assembled together to form a vertically extending column that has generally x-shaped horizontal cross-sections. Lower portions of each feed stalk 310 may include projections 316 that are inserted through slits in a feed board to mount the radiating element 300 thereon. The RF transmission lines 314 on the respective feed stalks 310 may center feed the dipoles 320-1, 320-2 via, for example, direct ohmic connections between the transmission lines 314 and the dipole arms 330.

The azimuth half power beamwidths of each low-band radiating element 300 may be in the range of 55 degrees to 85 degrees. In some embodiments, the azimuth half power beamwidth of each low-band radiating element 300 may be approximately 65 degrees.

Each dipole 320 may include, for example, two dipole arms 330 that are each between approximately 0.2 to 0.35 of an operating wavelength in length, where the "operating wavelength" refers to the wavelength corresponding to the center frequency of the operating frequency band of the radiating element 300. For example, if the low-band radiating elements 300 are designed as wideband radiating elements that are used to transmit and receive signals across the full 694-960 MHz frequency band, then the center frequency of the operating frequency band would be 827 MHz and the corresponding operating wavelength would be 36.25 cm.

As shown best in FIG. 6, the first dipole 320-1 extends along a first axis 322-1 and the second dipole 320-2 extends along a second axis 322-2 that is generally perpendicular to the first axis 322-1. Consequently, the first and second dipoles 320-1, 320-2 are arranged in the general shape of a cross. Dipole arms 330-1 and 330-2 of first dipole 320-1 are center fed by a common RF transmission line 314 and radiate together at a first polarization. In the depicted embodiment, the first dipole 320-1 is designed to transmit signals having a +45 degree polarization. Dipole arms 330-3 and 330-4 of second dipole 320-2 are likewise center fed by a common RF transmission line 314 and radiate together at a second polarization that is orthogonal to the first polarization. The second dipole 320-2 is designed to transmit signals having a −45 degree polarization. The dipole arms 330 may be mounted approximately 3/16 to ¼ an operating wavelength above the reflector 214 by the feed stalks 310.

Dipole arms 330-1, 330-2 each include first and second spaced-apart conductive segments 340-1, 340-2 that together form a generally oval shape. A bold dashed oval is superimposed on dipole arm 330-1 in FIG. 6 to illustrate the generally oval nature of the combination of conductive segments 340-1 and 340-2. The first conductive segment 340-1 may form half of the generally oval shape and the second conductive segment 340-2 may form the other half of the generally oval shape. Dipole arms 330-3, 330-4 similarly each include first and second spaced-apart conductive segments 350-1, 350-2 that together form a generally oval shape.

In the particular embodiment depicted in FIGS. 5-6, the portions of the conductive segments 340-1, 340-2, 350-1, 350-2 at the end of each dipole arm 330 that is closest to the center of each dipole 320 may have straight outer edges as opposed to curved configuration of a true oval. Likewise, the portions of the conductive segments 340-1, 340-2, 350-1, 350-2 at the distal end of each dipole arm 330 may also have straight or nearly straight outer edges. It will be appreciated that such approximations of an oval are considered to have a generally oval shape for purposes of this disclosure (e.g., an elongated hexagon has a generally oval shape).

The spaced-apart conductive segments 340-1, 340-2, 350-1, 350-2 may be implemented, for example, in a printed circuit board 332 and may lie in a first plane that is generally parallel to a plane defined by the underlying reflector 214 in some embodiments. All four dipole arms 330 may lie in this first plane. Each feed stalk 310 may extend in a direction that is generally perpendicular to the first plane.

Referring again to FIGS. 2-4, it can be seen that the low-band radiating elements 300 are taller (above the reflector 214) than both the mid-band radiating elements 400 and the high-band radiating elements 500. In order to keep the width of the base station antenna relatively narrow, the low-band radiating elements 300 may be located in very close proximity to both the mid-band radiating elements 400 and the high-band radiating elements 500. In the depicted embodiment, each low-band radiating element 300 that is adjacent a linear array 230 of mid-band radiating elements 400 may extend over a substantial portion of two of the mid-band radiating elements 400. Likewise, each low-band radiating element 300 that is adjacent a linear array 240 of high-band radiating elements 500 may vertically overlap at least a portion of one or more of the high-band radiating elements 500. This arrangement allows for a significant reduction in the width of the base station antenna 100. The term "vertically overlap" is used herein to refer to a specific positional relationship between first and second radiating elements that extend above a reflector of a base station antenna. In particular, a first radiating element is considered to "vertically overlap" a second radiating element if an imaginary line can be drawn that is perpendicular to the top surface of the reflector that passes through both the first radiating element and the second radiating element.

While positioning the low-band radiating elements 300 so that they vertically overlap the mid-band and/or the high-band radiating elements 400, 500 may advantageously facilitate reducing the width of the base station antenna 100, this approach may significantly increase the coupling of RF energy transmitted by the mid-band and/or the high-band radiating elements 400, 500 onto the low-band radiating elements 300, and such coupling may degrade the antenna patterns formed by the linear arrays 230, 240 of mid-band and/or high-hand radiating elements 400, 500. In order to reduce such coupling, the low-band radiating elements 300 may be designed to have two dipole arms 330-1, 330-3 that are substantially "transparent" to radiation emitted by the mid-band radiating elements 400, and dipole arms 330-2, 330-4 that are designed to be substantially transparent to radiation emitted by the high-band radiating elements 500. The dipole arms 330-1, 330-3 of the low-band radiating elements 300 that are substantially transparent to radiation emitted by the mid-band radiating elements 400 may be the dipole arms that project toward the mid-band radiating elements 400, while the dipole arms 330-2, 330-4 of the low-band radiating elements 300 that are substantially transparent to radiation emitted by the high-band radiating elements 500 may be the dipole arms that project toward the high-band radiating elements 500. Herein, a dipole arm of a radiating element that is configured to transmit RF energy in a first frequency band is considered to be "transparent" to RF energy in a second, different frequency band RF energy if the RF energy in the second frequency band poorly couples to the dipole arm. Accordingly, if a dipole arm of a first radiating element that is transparent to a second frequency band is positioned so that it vertically overlaps a second radiating element that transmits in the second frequency band, the addition of the first radiating element will not materially impact the antenna pattern of the second radiating element.

Dipole arms 330-1 and 330-3 may be more transparent to radiation emitted by the mid-band radiating elements 400 than are the dipole arms 330-2, 330-4. In other words, RF energy in the frequency range transmitted and received by the mid-band radiating elements 400 may more readily induce currents on dipole arms 330-2, 330-4 than on dipole arms 330-1, 330-3. Dipole arms 330-2 and 330-4 may be more transparent to radiation emitted by the high-band radiating elements 400 than are the dipole arms 330-1, 330-3. Thus, if the low-band radiating elements 300 were rotated 180 degrees so that dipole arms 330-1, 330-3 projected toward the high-band radiating elements 500 and dipole arms 330-2, 330-4 projected toward the mid-band radiating elements 400, more mid-band and high-band currents would be induced on the dipole arms 330 and the antenna patterns for the mid-band and high band linear arrays 230, 240 would be degraded.

Dipole arms 330-1 and 330-3 may be designed to be substantially transparent to radiation emitted by the mid-band radiating elements 400. This effect may be achieved by implementing the conductive segments 340-1, 340-2 as metal patterns that have a plurality of widened sections 342 that are connected by narrowed trace sections 344, as shown in FIGS. 5-6. As shown in FIG. 6, each widened section 342 of the conductive segments 340-1, 340-2 may have a respective length $L_1$ and a respective width $W_1$ in the first plane, where the length $L_1$ is measured in a direction that is generally parallel to the direction of current flow along the respective widened section 342 and the width $W_1$ is measured in a direction that is generally perpendicular to the direction of current flow along the respective widened section 342. The length $L_1$ and width $W_1$ of each widened section 342 need not be constant, and hence reference will be made herein to the average length and/or average width of each widened section 342. The narrowed trace sections 344 may similarly have a respective width $W_2$ in the first plane, where the width $W_2$ is measured in a direction that is generally perpendicular to the direction of instantaneous current flow along the narrowed trace section 344. The width $W_2$ of each narrowed trace section 344 also need not be constant, and hence reference will be made to the average width of each narrowed trace section 344.

The narrowed trace sections 344 may be implemented as meandered conductive traces. Herein, a meandered conductive trace refers to a non-linear conductive trace that follows a meandered path to increase the path length thereof. Using meandered conductive trace sections 344 provides a convenient way to extend the length of the narrowed trace section 344 while still providing a relatively compact conductive segment 340. This allows the widened trace sections 342 to be located in close proximity to each other so that the widened sections 342 will appear as a dipole at the low-band frequencies. As will be discussed below, these narrowed trace sections 344 may be provided to improve the performance of the antenna 100. The average width of each widened section 342 may be, for example, at least twice the average width of each narrowed trace section 344 in some embodiments. In other embodiments, the average width of each widened section 342 may be at least four times the average width of each narrowed trace section 344.

If conventional dipole arms were used instead of the dipole arms 330 in antenna 100, then RF energy that is transmitted and received by the mid-band radiating elements 400 may tend to induce currents on the conventional dipole arms, and particularly on the two dipole arms that vertically overlap the mid-band radiating elements 400. Such induced currents are particularly likely to occur when the low-band and mid-band radiating elements are designed to operate in frequency bands having center frequencies that are separated by about a factor of two, as a low-band dipole arm having a length that is a quarter wavelength of the low-band operating frequency will, in that case, have a length of approximately a half wavelength of the high-band operating frequency. The greater the extent that mid-band currents are induced on the low-band dipole arms, the greater the impact on the characteristics of the radiation pattern of the linear arrays 230 of mid-band radiating elements 400. While mid-band RF signals could also be induced on the other two conventional low-band dipole arms, coupling to these dipole arms may be low due to the increased separation between the two dipole arms that project away from the mid-band radiating elements 400, and hence only two of the four low-band dipole arms may have a significant impact on the radiation patterns of the linear arrays 230 of mid-band radiating elements 400.

With the low-band radiating elements 300 according to embodiments of the present invention, the narrowed trace sections 344 may be designed to act as high impedance sections that are designed to interrupt currents in the mid-band that could otherwise be induced on low-band dipole arms 330-1, 330-3. The narrowed trace sections 344 may be designed to create this high impedance for mid-band currents without significantly impacting the ability of the low-band currents to flow on the dipole arms 330-1, 330-3. As such, the narrowed trace sections 344 may reduce induced mid-band currents on the low-band dipole arms 330-1, 330-3 and consequent disturbance to the antenna pattern of the mid-band linear arrays 230. In some embodiments, the narrowed trace sections 344 may make the low-band dipole arms 330-1, 330-3 almost invisible to the mid-band radiating elements 400, and thus the low-band radiating elements 300 may not distort the mid-band antenna patterns.

Dipole arms 330-2 and 330-4 may similarly be designed to be substantially transparent to radiation emitted by the high-band radiating elements 500. This effect may again be achieved by implementing the conductive segments 350-1, 350-2 as metal patterns that have a plurality of widened segments 352 that are connected by one or more intervening narrowed trace sections 354. The narrowed trace sections 354 may be implemented as meandered conductive traces. Each widened section 352 of the conductive segments 350-1, 350-2 may have a respective length $L_3$ and a respective width $W_3$ in the first plane. The length $L_3$ and width $W_3$ of each widened section 352 need not be constant, and hence reference will be made to the average length and/or average width of each widened section 352. The narrowed trace sections 354 may similarly have a respective width $W_4$ in the first plane. The width $W_4$ of each narrowed trace section 354 also need not be constant. The average width of each widened section 352 may be, for example, at least four times the average width of each narrowed trace section 354 in some embodiments.

If conventional dipole arms were used instead of dipole arms 330 in antenna 100, then RF energy that is transmitted and received by the high-band radiating elements 500 may tend to induce currents on the conventional dipole arms, and particularly on the two dipole arms that vertically overlap the high-band radiating elements 500. With the low-band radiating elements 300 according to embodiments of the present invention, the narrowed trace sections 354 may be designed to act as high impedance sections that are designed to interrupt currents in the high-band that could otherwise be induced on low-band dipole arms 330-2, 330-4. The narrowed trace sections 354 may be designed to create this high impedance for high-band currents without significantly impacting the ability of the low-band currents to flow on the dipole arms 330-2, 330-4. As such, the narrowed trace sections 354 may reduce induced high-band currents on the low-band dipole arms 330-2, 330-4 and consequent disturbance to the antenna pattern of the high-band linear arrays 240. In some embodiments, the narrowed trace sections 354 may make the low-band dipole arms 330-2, 330-4 almost invisible to the high-band radiating elements 500, and thus the low-band radiating elements 300 may not distort the high-band antenna patterns.

In some embodiments, the low-band dipole arms 330-2, 330-4 may have at least 50% more widened sections 352 that the low-band dipole arms 330-1, 330-3 have widened sections 342. In other embodiments, the low-band dipole arms 330-2, 330-4 may have at least twice as many widened sections 352 than the low-band dipole arms 330-1, 330-3 have widened sections 342. Low-band dipole arms 330-1 and 330-3 may have the same number of widened sections 342 in some embodiments. Low-band dipole arms 330-2 and 330-4 may have the same number of widened sections 352 in some embodiments. The narrowed trace sections 354 may be shorter than the narrowed trace sections 344 included in the dipole arms 330-1, 330-3.

By implementing the dipole arms 330 as a series of widened sections 342, 352 that are connected by intervening narrowed trace sections 344, 354, each dipole arm 330 may act like a low pass filter circuit. The smaller the length of each widened segment 342, 352, the higher the cut off frequency of the low pass filter circuit. The length of each widened segment 342 and the electrical distance between adjacent widened segments 342 may be tuned so that the dipole arms 330-1, 330-3 are substantially transparent to mid-band RF radiation. The length of each widened segment 352 and the electrical distance between adjacent widened segments 352 may be tuned so that the dipole arms 330-2, 330-4 are substantially transparent to high-band RF radiation. Thus, by providing different designs for the dipole arms 330 that are adjacent the mid-band and high-band radiating elements 400, 500, the performance of base station antenna may be improved.

An average electrical distance between adjacent narrowed sections 354 of each second dipole arm 330-2, 330-4 is less than an average electrical distance between adjacent narrowed sections 344 of each first dipole arm 330-1, 330-3. An average length $L_2$ of the widened sections 352 of each second dipole arm 330-2, 330-4 is less than an average length $L_1$ of the widened sections 342 of the first dipole arm 330-1, 330-3.

As can further be seen in FIGS. 5-6, in some embodiments, the distal ends of the conductive segments 340-1, 340-2 may be electrically connected to each other so that the conductive segments 340-1, 340-2 form a closed loop structure. In the depicted embodiment, the conductive segments 340-1, 340-2 are electrically connected to each other by a narrowed trace section 344. In other embodiments, the widened sections 342 at the distal ends of conductive segments 340-1, 340-2 may merge together to form a single widened section 342. In still other embodiments, the distal ends of the conductive segments 340-1, 340-2 may not be electrically connected to each other. Any of these designs may likewise be used to implement the distal ends of conductive segments 350-1, 350-2.

In some embodiments, the physical length of dipole arms 330-1, 330-3 may exceed the physical length of dipole arms 330-2, 330-4. Additionally, In some embodiments, the "electrical length" of dipole arms 330-2, 330-4 may exceed the electrical length of dipole arms 330-1, 330-3. This longer electrical length may arise because of the shorter widened sections in dipole arms 330-2, 330-4. The "electrical length" of each of dipole arms 330-2, 330-4 is the length of the electrical path formed by conductive segment 350-1 plus the length of the electrical path formed by conductive segment 350-2. Similarly, the electrical length of each of dipole arms 330-1, 330-3 is the length of the electrical path formed by conductive segment 340-1 plus the length of the electrical path formed by conductive segment 340-2. By shortening the electrical length of the dipole arms 330-1, 330-3 that extend towards the high-band linear arrays 240 a skew may be generated in the antenna beams generated by the low-band linear arrays that may correct for an imbalance in the antenna beam that is created by the fact that the dipole arms 330-1, 330-3 are close to the edge of the reflector 214 and hence "see" less of the reflector 214 than do dipole arms 330-2, 330-4. This skew may also help improve the cross-polarization isolation performance of the low-band radiating elements 300. In some embodiments, an electrical length of dipole arms 330-2, 330-4 may exceed the electrical length of dipole arms 330-1, 330-3 by at least 3 percent. In other embodiments, the electrical length of dipole arms 330-2, 330-4 may exceed the electrical length of dipole arms 330-1, 330-3 by 5% to 15%

By forming each dipole arm 330 as first and second spaced-apart conductive segments, the currents that flow on the dipole arm 330 may be forced along two relatively narrow paths that are spaced apart from each other. This approach may provide better control over the radiation pattern. Additionally, by using the loop structure, the overall length of each dipole arm 330 may advantageously be reduced. Thus, the low-band radiating elements 300 according to embodiments of the present invention may be more compact and may provide better control over the radiation patterns, while also having very limited impact on the performance of closely spaced mid-band and high-band radiating elements 400, 500.

As noted above, the first dipole 320-1 is configured to transmit and receive RF signals at a +45 degree slant polarization, and the second dipole 320-2 is configured to transmit and receive RF signals at a −45 degree slant polarization. Accordingly, when the base station antenna 100 is mounted for normal operation, the first axis 322-1 of the first dipole 320-1 may be angled at about +45 degrees with respect to a longitudinal (vertical) axis L of the antenna 100, and the second axis 322-2 of the second dipole 320-2 may be angled at about −45 degrees with respect to the longitudinal axis L of the antenna 100.

As can best be seen in FIG. 6, central portions of each of the first and second dipole arms 330 extend in parallel to the first axis 322-1, and central portions of each of the third and fourth dipole arms 330 extend in parallel to the second axis 322-2. Moreover, the dipole arms 330 as a whole extend generally along one or the other of the first and second axes 322-1, 322-2. Consequently, each dipole 320 will directly radiate at either the +45° or the −45° polarization.

Figure 7:
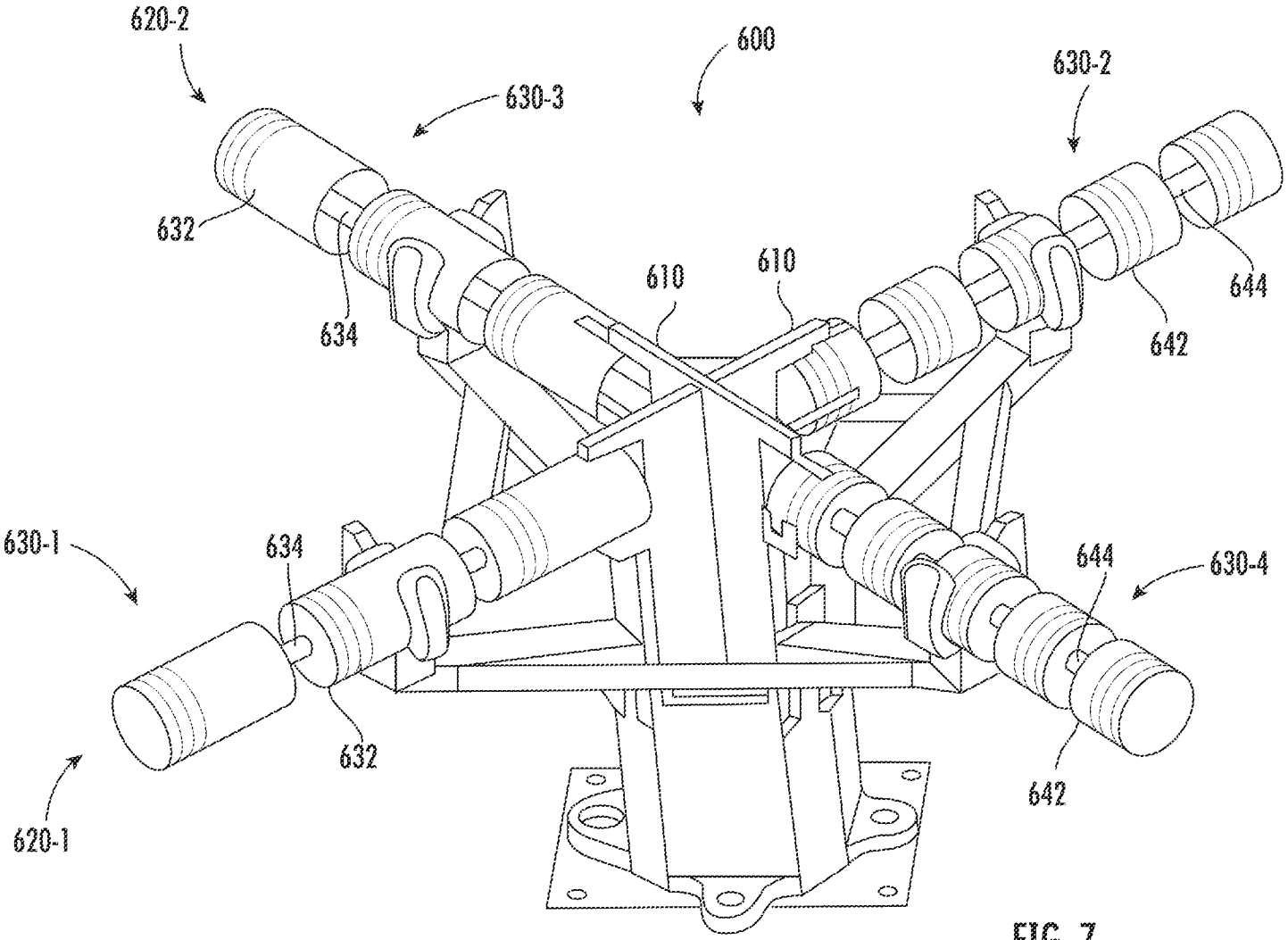
FIG. 7 is a perspective view of a low-band radiating element according to further embodiments of the present invention.

FIG. 7 is a perspective view of a low-band radiating element 600 according to further embodiments of the present invention. As shown in FIG. 7, the low-band radiating element 600 is a dual-polarized cross-dipole radiating element that includes a pair of feed stalks 610 and first and second dipoles 620-1, 620-2. The first dipole 620-1 includes dipoles arms 630-1, 630-2 that extend along a first axis, and the second dipole 620-2 includes dipoles arms 630-3, 630-4 that extend along a second axis that is substantially perpendicular to the first axis.

The feed stalks 610 may each comprise a printed circuit board that has RF transmission lines (not shown) formed thereon. Each feed stalk 610 includes a slit so that the feed stalks 610 can be assembled together to form a vertically extending column that has generally x-shaped horizontal cross-sections. Each dipole arm 630 may be electrically connected to one of the feed stalks 610.

Each dipole arm 630 may have a length that is, for example, between ⅜ to ½ of a wavelength in length, where the "wavelength" refers to the wavelength in the middle of the frequency range of the low band. Dipole arms 630-1 and 630-2 together form the first dipole 620-1 and are configured to transmit signals having a +45 degree polarization. Dipole arms 630-3 and 630-4 together form the second dipole 620-2 and are configured to transmit signals having a −45 degree polarization. The dipole arms 630 may be mounted approximately a quarter wavelength above a reflector by the feed stalks 610.

Each dipole arm 630-1, 630-3 may comprise an elongated center conductor 634 that has a series of coaxial chokes 632 mounted thereon. Each coaxial choke 632 comprises a hollow metal tube that has an open end and a closed end that is grounded to the center conductor 634. The size, number of and distance between the coaxial chokes 632 included in dipole arms 630-1 and 630-3 may be designed to create a quarter wavelength well in the frequency range of the mid-band radiating elements in order to make dipole arms 630-1, 630-3 substantially transparent to RF energy in the mid-band. Each dipole arm 630-2, 630-4 may comprise an elongated center conductor 644 that has a series of coaxial chokes 642 mounted thereon. Each coaxial choke 642 comprises a hollow metal tube that has an open end and a closed end that is grounded to the center conductor 644. The size, number of and distance between the coaxial chokes 642 included in dipole arms 630-2 and 630-4 may be designed to create a quarter wavelength well in the frequency range of the high-band radiating elements in order to make dipole arms 630-2, 630-4 substantially transparent to RF energy in the high-band. As can be seen, the number of coaxial chokes 642 and the size of the coaxial chokes 642 included on dipole arms 630-2, 630-4 may be less than the number of coaxial chokes 632 and the size of the coaxial chokes 632 included on dipole arms 630-1, 630-3. Each coaxial choke 632, 642 may be viewed as a widened section of its respective dipole arm 630, and the segments of the center conductors 634, 644 between adjacent coaxial chokes 632, 642 may be viewed as narrowed sections of the respective dipole arms 630.

The linear arrays 220 of the base station antenna 100 of FIGS. 1-4 may include the radiating elements 600 instead of the radiating elements 300 according to further embodiments of the present invention. The dipole arms 630-1, 630-3 of each radiating element 600 may project toward the mid-band radiating elements 400 and the dipole arms 630-2, 630-4 may project toward the high-band radiating elements 500. In some embodiments, at least some of the dipole arms 630-1, 630-3 may vertically overlap respective ones of the mid-band radiating elements 400, and/or at least some of the dipole arms 630-2, 630-4 may vertically overlap respective ones of the high-band radiating elements 500. Since the radiating elements 600 may have dipole arms 630 that are substantially transparent to RF energy in two different frequency bands, they may be used in tri-band base station antennas and allow the linear arrays thereof to be positioned more closely together.

While the example embodiments described above have low-band radiating elements that are designed to be transparent to RF energy radiated in two higher frequency bands, it will be appreciated that embodiments of the present invention are not limited thereto. For example, in other embodiments, mid-band radiating elements may be provided that have first dipole arms that are configured to be substantially transparent to RF energy in a lower frequency band and second dipole arms that are configured to be substantially transparent to RF energy in a higher frequency band.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, operations, elements, and/or components, but do not preclude the presence or addition of one or more other features, operations, elements, components, and/or groups thereof.

Aspects and elements of all of the embodiments disclosed above can be combined in any way and/or combination with aspects or elements of other embodiments to provide a plurality of additional embodiments.

That which is claimed is:

1. A radiating element, comprising:

a first dipole that extends along a first axis and that is configured to transmit RF signals in a first frequency band, the first dipole including a first dipole arm and a second dipole arm, wherein the first dipole arm is configured to be substantially transparent to RF signals in a second frequency band, and the second dipole arm is configured to be substantially transparent to RF signals in a third frequency band.

2. The radiating element of claim 1, wherein the first frequency band is a low-band frequency band, the second frequency band is a mid-band frequency band, and the third frequency band is a high-band frequency band.

3. The radiating element of claim 1, further comprising a second dipole that extends along a second axis and that is configured to transmit RF signals in the first frequency band, the second dipole including a third dipole arm and a fourth dipole arm, and the second axis being generally perpendicular to the first axis.

4. The radiating element of claim 3, wherein the third dipole arm is configured to be substantially transparent to RF signals in the second frequency band, and the fourth dipole arm is configured to be substantially transparent to RF signals in the third frequency band.

5. The radiating element of claim 3, wherein each of the first through fourth dipole arms comprises an elongated center conductor having a plurality of coaxial chokes mounted thereon.

6. The radiating element of claim 5, wherein the second dipole arm has less coaxial chokes than the first dipole arm.

7. A radiating element, comprising:

a first dipole that extends along a first axis and that is configured to transmit RF signals in a first frequency band, the first dipole including a first dipole arm and a second dipole arm, wherein each of the first and second dipole arms comprises an elongated center conductor having a plurality of coaxial chokes mounted thereon, and the second dipole arm has less coaxial chokes than the first dipole arm.

8. The radiating element of claim 7, further comprising a second dipole that extends along a second axis and that is configured to transmit RF signals in the first frequency band, the second dipole including a third dipole arm and a fourth dipole arm, and the second axis being generally perpendicular to the first axis.

9. The radiating element of claim 8, wherein each of the third and fourth dipole arms comprises an elongated center conductor having a plurality of coaxial chokes mounted thereon.

10. The radiating element of claim 9, wherein the fourth dipole arm has less coaxial chokes than the third dipole arm.

11. The radiating element of claim 7, wherein each of the plurality of coaxial chokes comprises a hollow metal tube.

12. The radiating element of claim 11, wherein the hollow metal tube has an open end and a closed end, and the closed end is grounded to the elongated center conductor.

13. The radiating element of claim 7, wherein each of the plurality of coaxial chokes of the second dipole arm are smaller in size than each of the plurality of coaxial chokes of the first dipole arm.

14. The radiating element of claim 7, wherein each of the first and second dipole arms has a length that is between ⅜ to ½ of a wavelength in length, the wavelength corresponding to a center frequency of the first frequency band.

15. The radiating element of claim 7, wherein the first and second dipole arms are configured to transmit signals having a +45 degree polarization.

16. The radiating element of claim 8, wherein the third and fourth dipole arms are configured to transmit signals having a −45 degree polarization.

17. The radiating element of claim 8, further comprising a pair of feed stalks, wherein each of the first through fourth dipole arms is connected to one of the feed stalks of the pair of feed stalks.

18. The radiating element of claim 17, wherein each of the feed stalks of the pair of feed stalks comprises a printed circuit board having RF transmission lines formed thereon.

19. A method of forming a dual-polarized radiating element that operates in a first frequency band, the method comprising:

mounting a vertically extending column on a reflector surface, wherein the vertically extending column is comprised of a first feed stalk that is joined with a second feed stalk such that the vertically extending column has generally x-shaped cross-sections;

mounting a first dipole that includes a first dipole arm and a second dipole arm that extend along a first axis a quarter wavelength forwardly of the reflector surface on the vertically extending column;

mounting a second dipole that includes a third dipole arm and a fourth dipole arm that extend along a second axis that is generally perpendicular to the first axis a quarter wavelength forwardly of the reflector surface on the vertically extending column; and electrically connecting each of the first through fourth dipole arms to one of the first feed stalk and the second feed stalk, wherein the first dipole arm is configured to be substantially transparent to RF signals in a second frequency band, and the second dipole arm is configured to be substantially transparent to RF signals in a third frequency band.

20. The method of claim 19, wherein each of the first through fourth dipole arms comprises an elongated center conductor having a plurality of coaxial chokes mounted thereon.

* * * * *